US006161558A

United States Patent [19]

Franks et al.

[11] Patent Number: 6,161,558

[45] Date of Patent: Dec. 19, 2000

[54] PORTABLE CLEAN-IN-PLACE SYSTEM FOR BATCH PROCESSING EQUIPMENT

[75] Inventors: John W. Franks, South Beloit, Ill.; Dale A. Seiberling, Vero Beach, Fla.

[73] Assignee: Electrol Specialties Company, South Beloit, Ill.

[21] Appl. No.: 09/199,999

[22] Filed: Nov. 25, 1998

[51] Int. Cl.[7] ..... B08B 3/04

[52] U.S. Cl. ..... 134/57; 134/103.1; 134/115; 134/166 C; 134/169 C; 134/174

[58] Field of Search ..... 134/54 R, 105, 134/103.1, 115 R, 166 R, 168 R, 166 C, 165 C, 172, 174, 198

[56] References Cited

U.S. PATENT DOCUMENTS

| | | | |
|---|---|---|---|
| 1,842,099 | 1/1932 | Johnson . | |
| 2,717,576 | 9/1955 | Hansen | 119/14.18 |
| 2,808,025 | 10/1957 | Graves | 119/14.01 |
| 2,897,829 | 8/1959 | Arrington et al. | 134/99 |
| 2,915,073 | 12/1959 | Merritt | 134/58 |
| 3,119,400 | 1/1964 | Bihler | 134/57 |
| 3,122,149 | 2/1964 | Hauk et al. | 134/58 |
| 3,417,763 | 12/1968 | Fjermestad et al. | 134/58 |
| 3,536,081 | 10/1970 | Riess | 134/22 |
| 3,670,744 | 6/1972 | Bender | 134/57 R |
| 3,810,787 | 5/1974 | Yoeli et al. | 134/29 |
| 3,830,248 | 8/1974 | Brown | 134/100 |
| 4,552,162 | 11/1985 | Finger . | |
| 4,991,608 | 2/1991 | Schweiger . | |
| 5,109,880 | 5/1992 | Booth . | |
| 5,211,203 | 5/1993 | Vollweiler et al. | 137/355.17 |
| 5,405,452 | 4/1995 | Anderson et al. | 134/22.12 |
| 5,427,126 | 6/1995 | Carney et al. | 134/98.1 |
| 5,529,605 | 6/1996 | Mussig et al. | 75/670 |
| 5,680,877 | 10/1997 | Edstrand et al. | 134/103.1 |

OTHER PUBLICATIONS

The Secret's Out Clean In Place, Feature Report, p. 1–8 Jesse C. Stewart and Dale Seiberling.

*Primary Examiner*—Frankie L. Stinson
*Attorney, Agent, or Firm*—Leydig, Voit & Mayer, Ltd.

[57] ABSTRACT

A portable clean-in-place apparatus for a batch processing system. The present invention provides a clean-in-place system on a movable frame adapted to move about a batch processing facility such as a dairy, brewery, pharmaceutical plant, or the like, and clean any or all portions of the batch processing system. Since the CIP system is provided on a movable frame, it can be moved without requiring fixed piping to and from the batch processing line, and since it is relatively small in dimension, it can fit through a standard size doorway to facilitate storage. Moreover, through appropriately sizing and orienting the equipment the apparatus is not only kept relatively small, but can be manufactured at a relatively low cost as well.

23 Claims, 9 Drawing Sheets

PORTABLE CLEAN-IN-PLACE SYSTEM FOR BATCH PROCESSING EQUIPMENT

FIELD OF THE INVENTION

The present invention generally relates to cleaning equipment, and more particularly relates to clean-in-place apparatus for cleaning physically fixed or portable tanks, piping, and associated hardware of batch processing systems.

BACKGROUND OF THE INVENTION

With many types of batch processing equipment, such as those found in dairies, breweries, and pharmaceutical plants, equipment of the batch processing facility needs to be cleaned between each lot of product processed through the system. The equipment typically includes such devices as tanks, pumps, valves and variously sized piping. Such a cleaning process not only makes for a better and more useful product, but is often required by governmental regulations, including FDA protocols.

However, such tanks, piping, and related hardware are often large in scope and difficult to access, thereby making the cleaning process quite cumbersome and costly. In early attempts, the large scale tanks of such operations would be manually scrubbed. While this method was sometimes effective, it was unduly dependent on the skill and diligence of the individual worker, and could often result in a physically hazardous environment for the worker. It can therefore be seen that such prior art systems resulted in excessive labor requirements, with little or no method by which the cleaning process could be verified or validated.

In recognition of these difficulties, many batch processing plants began to use a clean-in-place (CIP) procedure which would allow the equipment of the batch processing system to remain physically assembled and would rely upon the temperature, pressure, and chemical concentration of cleaning solution recirculated through the batch processing system to effect the cleaning process. In other words, after each lot processed through the batch processing equipment, the equipment would be shut-down, and a CIP apparatus would be connected and activated. The CIP apparatus would be connected directly to the batch processing system, and would deliver flush, wash, and rinse solutions through the tanks, piping, and valves of the batch processing system for cleaning purposes.

More specifically, the CIP cleaning cycle would normally begin with a pre-rinse cycle wherein relatively low grade water would be pumped through the batch processing system for the purpose of removing "loose" soil in the system and carrying the soil to drain. Typically, an alkaline and/or acid wash would then be recirculated through the batch processing systems at an elevated temperature. The actual choice between acid or alkaline or both would be governed by the type of operation and soil to be removed. This wash would chemically react with the soiled surfaces of the batch processing system to further remove soil. A third step would again rinse the system to drain with water, prior to an optional fourth step wherein an acid rinse would be recirculated through the batch processing system. The acid rinse would neutralize and remove residual alkaline cleaner and remove any mineral deposits left by the water. Finally, a post-rinse cycle would be performed, typically using a high grade of water or recirculated sanitizing rinse. The post-rinse cycle would typically be performed at an elevated temperature to permit fast drying of the equipment. Such CIP systems are well known in the art, with U.S. Pat. Nos. 2,897,829, and 5,427,127 serving as two examples.

While such physically fixed CIP systems have proven to be effective in cleaning the components of batch processing systems, they are not without drawbacks, namely, manifesting themselves in the form of expense and an inability to be easily modified. With regard to expense, it can be seen that such known CIP systems require additional piping, pumps, valves, and tanks for cleaning purposes. The CIP equipment is typically installed in a distinct area of the batch processing facility often requiring relatively large amounts of floor space. In addition, if the batch processing system is at all modified, the CIP solution distribution piping must be modified accordingly, at added expense, and additional down-time for the batch processing system. Moreover, it is sometimes necessary to clean only portions of a batch processing system, or clean additional, sometimes smaller batch processing system components. For example, a research and development laboratory or pilot plant for batch processes will require its equipment to be cleaned frequently for effective testing of the process. Such R & D and pilot plant facilities are commonly equipped with the same large scale CIP equipment as that applied to the actual production batch processing system equipment, at an unnecessary expense.

It would therefore be advantageous to provide a portable CIP unit which could be easily moved about a batch processing facility to clean any or all portions of the batch processing equipment, while at the same time occupying relatively little facility floor space, and allowing great versatility in cleaning operations as the configuration of the batch processing system changes.

SUMMARY OF THE INVENTION

It is therefore an objective of the present invention to provide a portable clean-in-place apparatus for a batch processing system.

It is another objective of the present invention to provide a more efficient and uniquely down-sized CIP apparatus which can be used to clean large and small batch processing systems.

It is yet another objective of the present invention to uniquely minimize the elevation from the floor of the return flow manifold to thereby allow for gravity return from small tanks with relatively low outlet ports.

It is still another objective of the present invention to provide a CIP system on a wheeled platform dimensioned to fit through a standard door width to facilitate movement of the CIP system from area to area.

In accordance with these objectives, it is a feature of a preferred embodiment of the present invention to provide a portable clean-in-place apparatus comprising a movable frame, a water tank, a heat exchanger, a supply pump, and at least one chemical supply. The system includes a solution supply port and a solution return port with an interconnected piping loop to release chemicals into the solution being created to clean the batch processing equipment. The solution return port is adapted to receive recirculated cleaning solution and removed soil from the batch processing apparatus. The water tank has at least one inlet and at least one outlet with the inlet adapted to be connected to a water supply. The heat exchanger is mounted to the frame and has an inlet and an outlet with the inlet connected to the outlet of the supply pump. The chemical supply and chemical supply pump are integrated into the system to precisely control the cleaning solution concentration. These are connected through a piping loop between the supply side piping and return side piping.

It is another feature of a preferred embodiment of the present invention to provide a portable clean-in-place apparatus mounted on a movable frame having conveniently positioned connection ports.

It is another feature of a preferred embodiment of the present invention to provide a portable clean-in-place apparatus having a water tank adapted to be connected to first and second water supplies of differing quality.

It is another feature of a preferred embodiment of the present invention to provide a portable clean-in-place apparatus wherein the heat exchanger can be either steam or electric powered.

It is another feature of a preferred embodiment of the present invention to provide a portable clean-in-place apparatus having first and second chemical supplies wherein the first supply is alkaline, and the second chemical supply is acidic.

It is yet another feature of a preferred embodiment of the present invention to provide a portable clean-in-place apparatus wherein the various pumps and valves of the system are centrally controlled by a programmable logic controller.

It is still another feature of a preferred embodiment of the present invention to provide a portable clean-in-place apparatus in the form of a movable frame supported on casters, with the frame being no more than three feet wide, seven feet long, and six feet high to thereby facilitate movement of the portable CIP system through a standard size doorway.

It is yet another feature of a preferred embodiment of the present invention to provide a portable clean-in-place apparatus using vertically mounted pumps to thereby minimize the space requirements of the system.

It is still another feature of a preferred embodiment of the present invention to provide the CIP return inlet at the lowest possible elevation to thereby best enable gravity flow of fluid from the batch processing system component, generally a tank, back to the CIP unit.

It is still another feature of a preferred embodiment of the present invention to provide an enlarged diameter horizontally disposed reservoir in the CIP return inlet, with a weir disposed downstream in the CIP return inlet to thereby maintain a minimum level of fluid in the CIP return inlet for short periods of time to facilitate function of various sensing probes disposed in the reservoir, while still enabling the reservoir to drain completely.

It is still another feature of a preferred embodiment of the present invention to provide a CIP system that is fully drainable.

It is still another feature of a preferred embodiment of the present invention to provide a CIP system that contains no dead legs greater than one and one-half pipe diameters, to thereby avoid any stagnation areas during cleaning cycles.

It is still another feature of a preferred embodiment of the present invention to provide a CIP system that is self-cleaning in itself.

It is another feature of a preferred embodiment of the present invention to provide a batch processing system having the aforementioned portable clean-in-place system.

These and other objectives and features of the invention will become more apparent from the following detailed description when taken in conjunction with the accompanying drawings.

Figure 1:
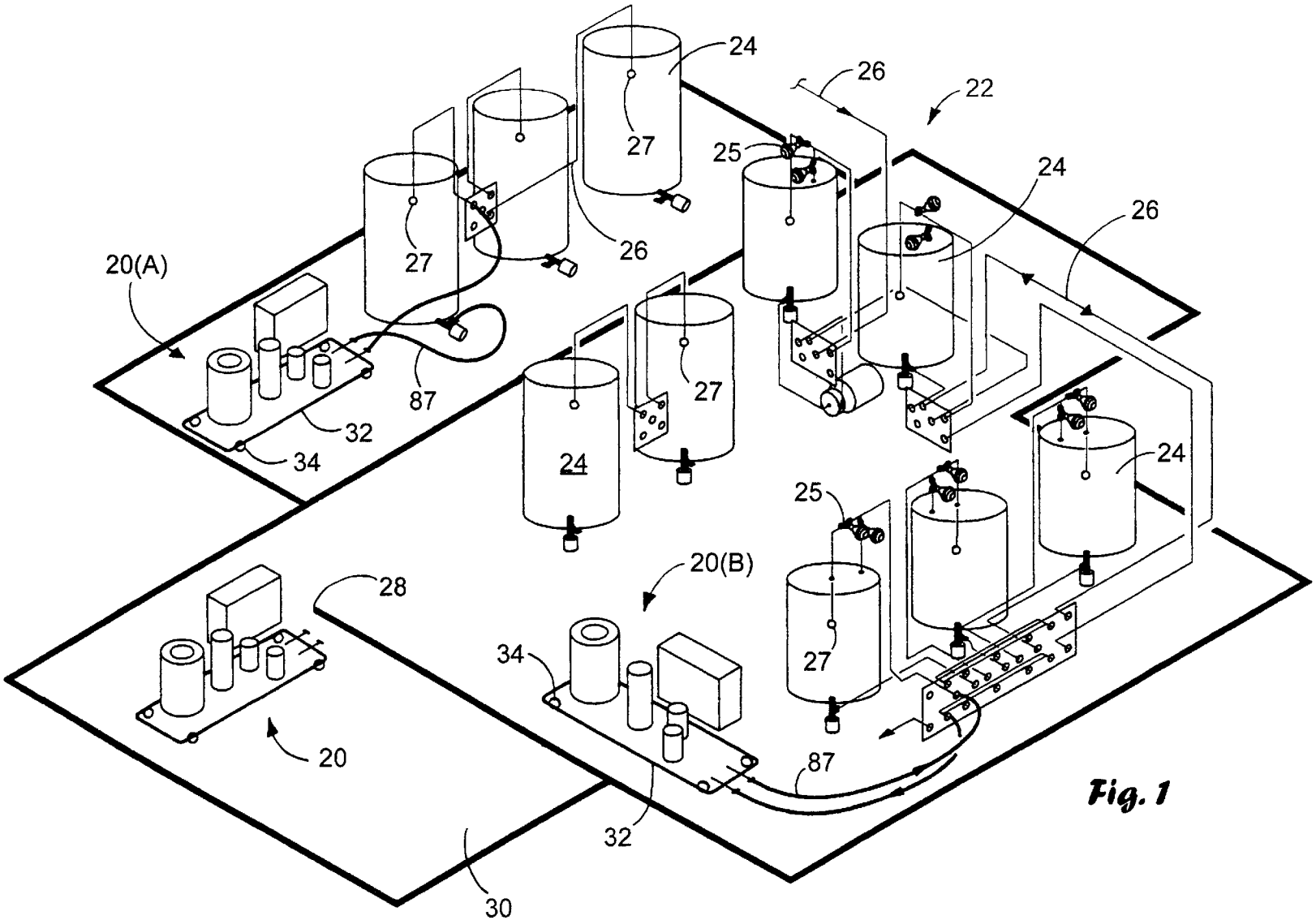
FIG. 1 is a schematic representation of the preferred embodiment.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and with particular reference to FIG. 1, a preferred embodiment of the present invention is shown as portable clean-in-place (CIP) apparatus 20. As shown therein, portable CIP apparatus 20 can be moved about batch processing facility 22 for cleaning of batch processing tanks 24 with sprays 27, batch processing piping 26, valves 25, and related hardware. By way of example, and not of limitation, it can be seen that portable CIP apparatus 20 can be moved to position A for cleaning one portion of batch processing facility 22, and can be moved to position B for cleaning of another portion of facility 22. In addition, it can be seen that portable CIP apparatus 20 is dimensioned to fit through a standard size doorway 28 as will be described in further detail herein. In so doing, portable CIP system 20 can be moved into a storage or auxiliary room 30 of facility 22 without occupying valuable floor space within the processing area of facility 22.

Figure 2:
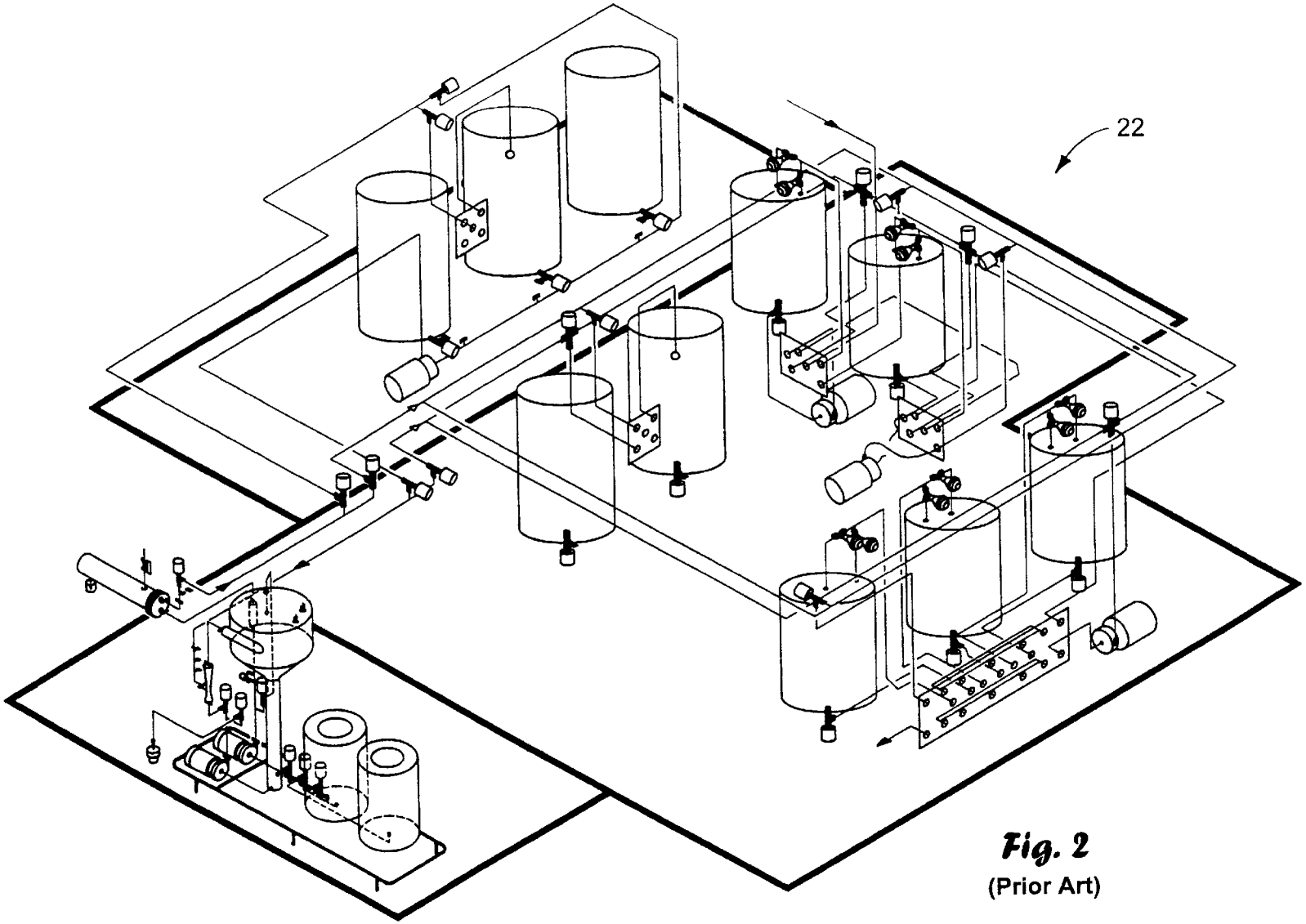
Fig. 2 (Prior Art)
FIG. 2 is a schematic representation of a prior art fixed CIP system.

By way of contrast, a prior art batch processing facility and conventional CIP system are shown in FIG. 2. As can be seen therein, the CIP apparatus is physically fixed in place and requires separate piping lines to be run to and from each of the areas of the batch processing facility. Therefore, if the batch processing facility is ever modified, the piping to and from the CIP system must accordingly be modified as well.

Figure 3:
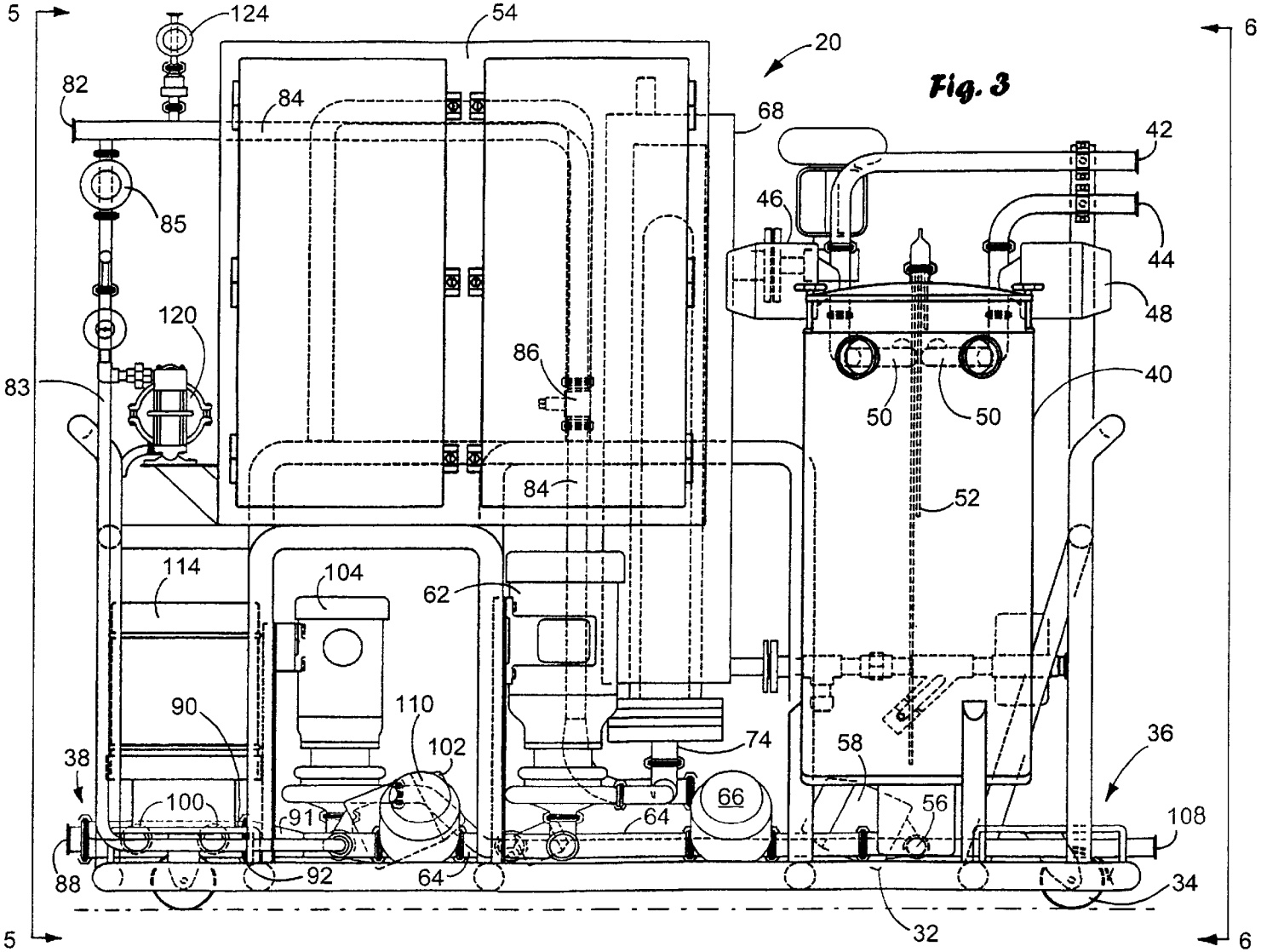
FIG. 3 is a side view of a preferred embodiment of the present invention.

Referring now to FIG. 3, portable CIP apparatus 20 is shown in detail. CIP system 20 includes frame 32 mounted on casters 34. In the preferred embodiment of the present invention, casters 34 proximate front end 36 are provided in the form of swivel casters 34 while casters 34 provided proximate back end 38 are fixed casters. However, in alternative embodiments, different configurations are possible, as well as different mechanisms for allowing frame 32 to be portable without effecting the efficacy of the present invention.

Figure 4:
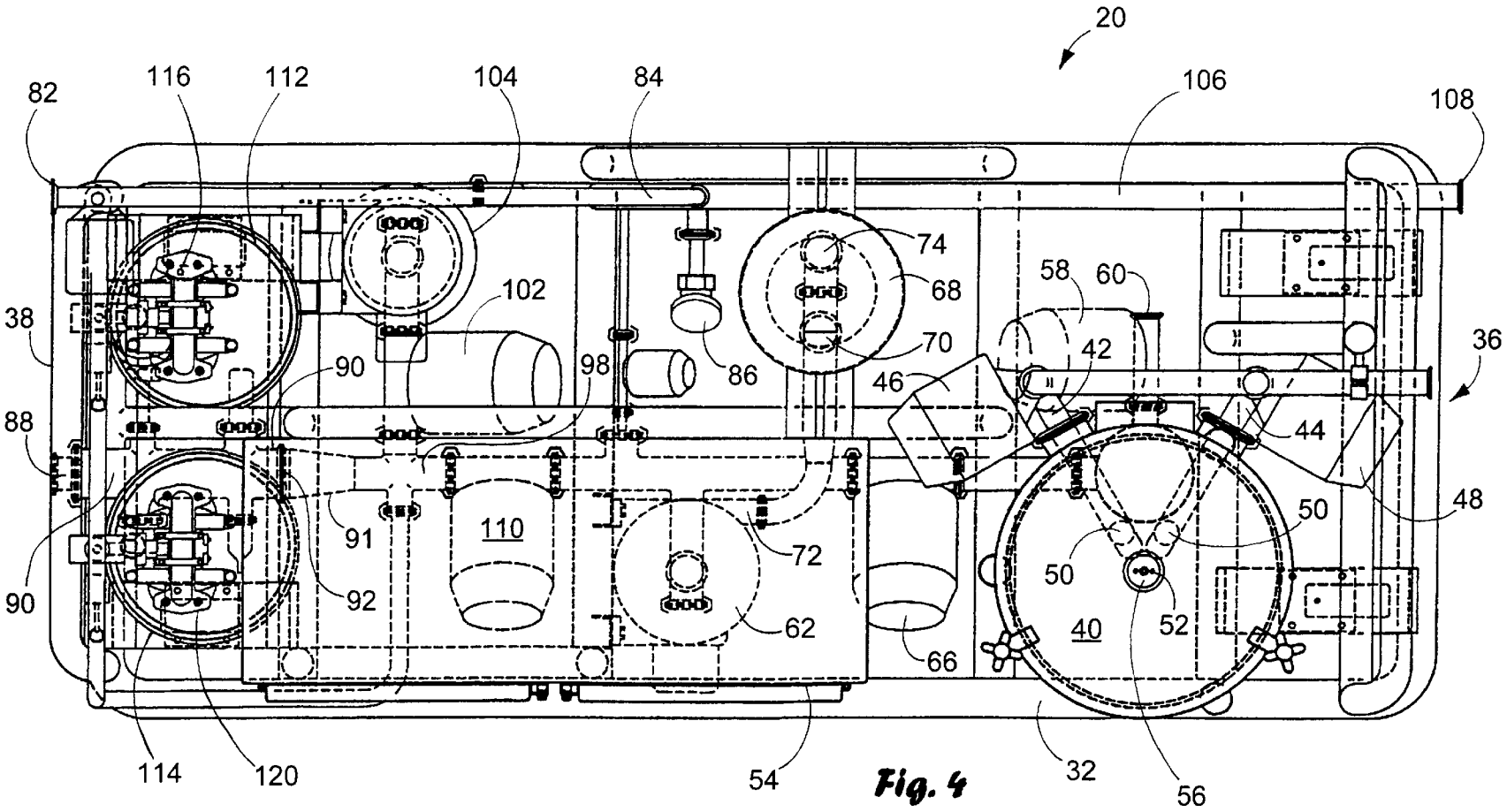
FIG. 4 is a top view of the embodiment shown in FIG. 3.

As shown in FIGS. 3 and 4, water tank 40 is mounted on frame 32 proximate front end 36. Water tank has first and second inlets 42 and 44 adapted to be connected to first and second water supplies of differing quality as will be described in further detail herein. Water valve 46 controls flow of water through first tank inlet 42, while water valve 48 controls the flow of water through second tank inlet 44. Water tank 40 includes spray nozzles 50 which enable the water to enter water tank 40 in a pattern which ensures coverage of the entire interior surface of water tank 40. In addition, a level probe 52 is provided within water tank 40 and is connected to central processor 54 to constantly monitor the level of fluid in water tank 40.

Water tank 40 includes pod outlet 56 which can be connected to one of two destinations. As shown best in FIG. 4, if tank outlet valve 58 is open, the contents of water tank 40 can be emptied to the environment, or a suitable drain provided in the batch processing facility 22 through drain pipe 60. However, if tank outlet valve 58 is closed and valve 66 is open, the contents of water tank 40 will be directed to CIP supply pump 62 and thus to batch processing facility 22. More specifically, a pump suction manifold 64 connects tank outlet valve 66 to CIP supply pump 62 controlling flow between tank outlet 56 and CIP supply pump 62. As shown therein, specifically FIG. 3, CIP supply pump 62 is vertically mounted to thereby occupy the minimum amount of space on frame 32. However, it is to be understood that pump 62 can be mounted differently while still falling within the scope of the present invention.

Figure 8:
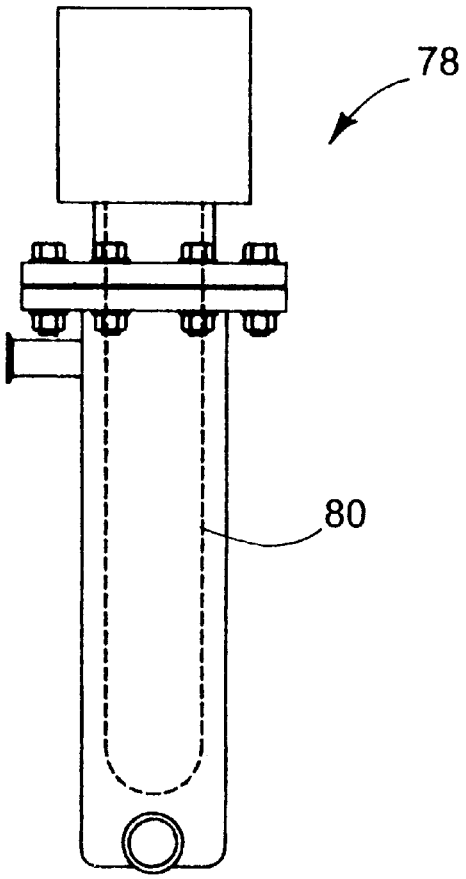
FIG. 8 is a plan view of the alternative electric heat exchanger.

In order to effectively clean the piping and tanks of batch processing facility 22, the solution delivered therethrough often needs to be provided at an elevated temperature. The portable CIP apparatus 20 therefore includes a heat exchanger, shown in FIGS. 3 and 4 as being a steam-powered heat exchanger 68. Heat exchanger 68 includes an inlet 70 connected to CIP supply pump outlet 72 as well as an outlet 74 (See FIG. 4). As the fluid passes through heat exchanger 68, it is heated as heat is dissipated from steam as the fluid flows through heat exchanger 68. It is to be understood that in alternative embodiments, heat exchanger 68 need not be steam powered, and in fact can be electrically powered using alternative heat exchanger 78 shown in FIG. 8. Electric heat exchanger 78 functions by having resistance element 80 elevate in temperature as electric current is run therethrough against significant resistance.

Referring again to FIG. 3, heat exchanger outlet 74 is connected to CIP supply outlet 82 by piping 84. A flow meter 86 is provided within piping 84 to monitor the rate of flow through piping 84. This information is communicated to central processor 54. In the preferred embodiment, flow meter 86 is a turbine meter, but in alternative embodiments, different types of meters can be similarly employed.

It can therefore be seen from FIG. 3 that CIP supply outlet 82 is provided at an elevated height on back end 38 of portable CIP apparatus 20. When portable CIP apparatus 20 is moved proximate the position of the batch processing facility 22 in need of cleaning, a flexible conduit 87 (FIG. 1) can then be used to connect CIP supply outlet 82 to a CIP supply connection of batch processing facility 22. Once the fluid has passed through batch processing facility 22, the fluid and the soil it has removed are communicated back to portable CIP apparatus 20 through CIP return inlet 88. CIP return inlet 88 is then in turn connected to a CIP return sensor manifold 90 having an enlarged diameter mouth 91 relative to the pump suction manifold 64 and piping 84. Preferably, the cross sectional area of CIP return sensor manifold 90 is twice that of pump section manifold 64.

Figure 7:
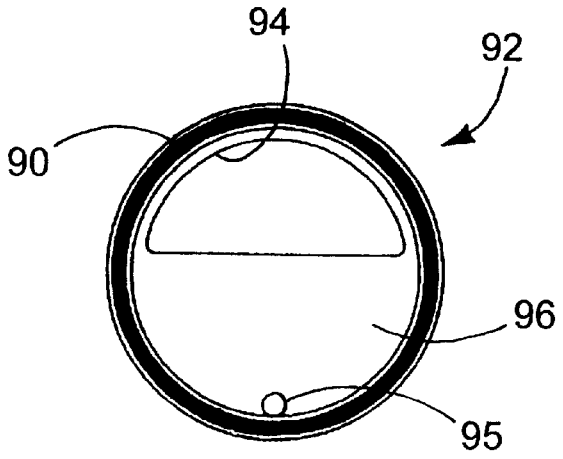
FIG. 7 is an end view of the weir.

Downstream of CIP return inlet 88 a weir 92 is provided to serve as a form of a self-draining dam within manifold 90. As shown in FIG. 7, weir 92 is circular in shape and adapted to substantially close CIP return sensor manifold 90 except for opening 94 provided in its upper half. Therefore, when fluid flows into a CIP return sensor manifold, it is initially prevented from passage via solid bottom 96 of weir 92, but when the level of the fluid rises above solid bottom 96, it passes through weir opening 94 and downstream into return manifold 98. A small diameter drainage aperture 95 is provided in solid bottom 96 to allow complete drainage after an extended period of time.

Weir 92 therefore accomplishes many functions, among which is the maintenance of a certain level of fluid within CIP return sensor manifold 90. A number of sensing probes 100 can then be provided within CIP return manifold 90 to monitor such parameters as temperature and chemical concentration level within the fluid. This information can then be communicated to central processor 54.

Figure 6:
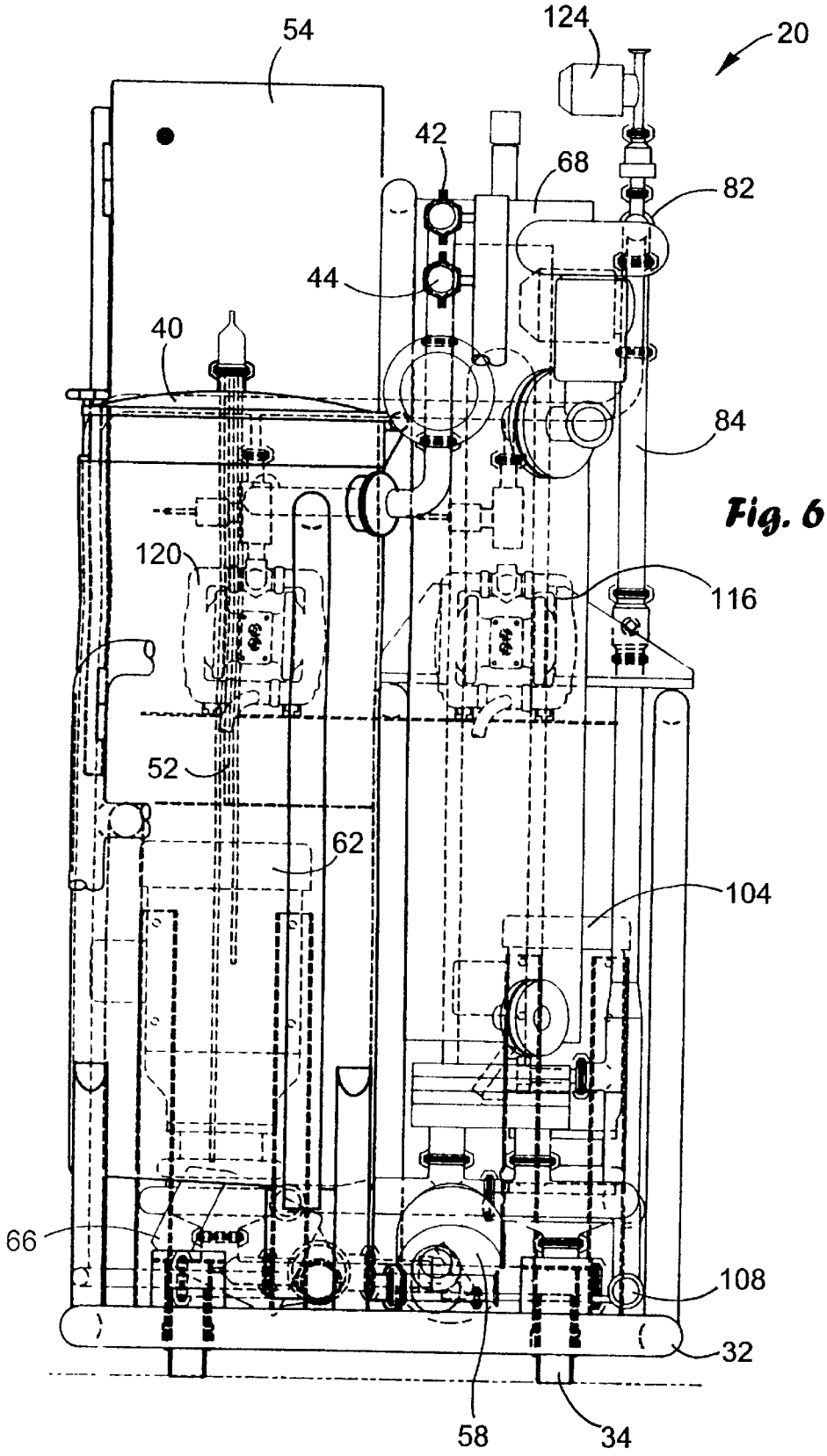
FIG. 6 is an end view of FIG. 3 taken along the line 6—6.

Once the fluid reaches return manifold 98, it can proceed in one of two directions. If drain pump valve 102 is open and return blocking valve 110 is closed, the fluid can be drawn via optional drain pump 104 and exit CIP apparatus 20 via drain pipe 106. Alternatively, the solution can be drawn by gravity via drain pipe 106. As shown in FIG. 6, drain pipe 106 includes an exit in front end 36 of CIP apparatus 20. Drain pipe exit 108 can be connected via a suitable hose (not shown) to a drain provided in batch processing facility 22.

However, if drain pump valve 102 is closed, the fluid can continue through return manifold 98 and back to supply pump 62 for recirculation to the batch processing equipment. A return blocking valve 110 is provided in return manifold 98 to control the flow of fluid therethrough. At this point the recirculation of the fluid through CIP apparatus 20 will repeat.

Figure 5:
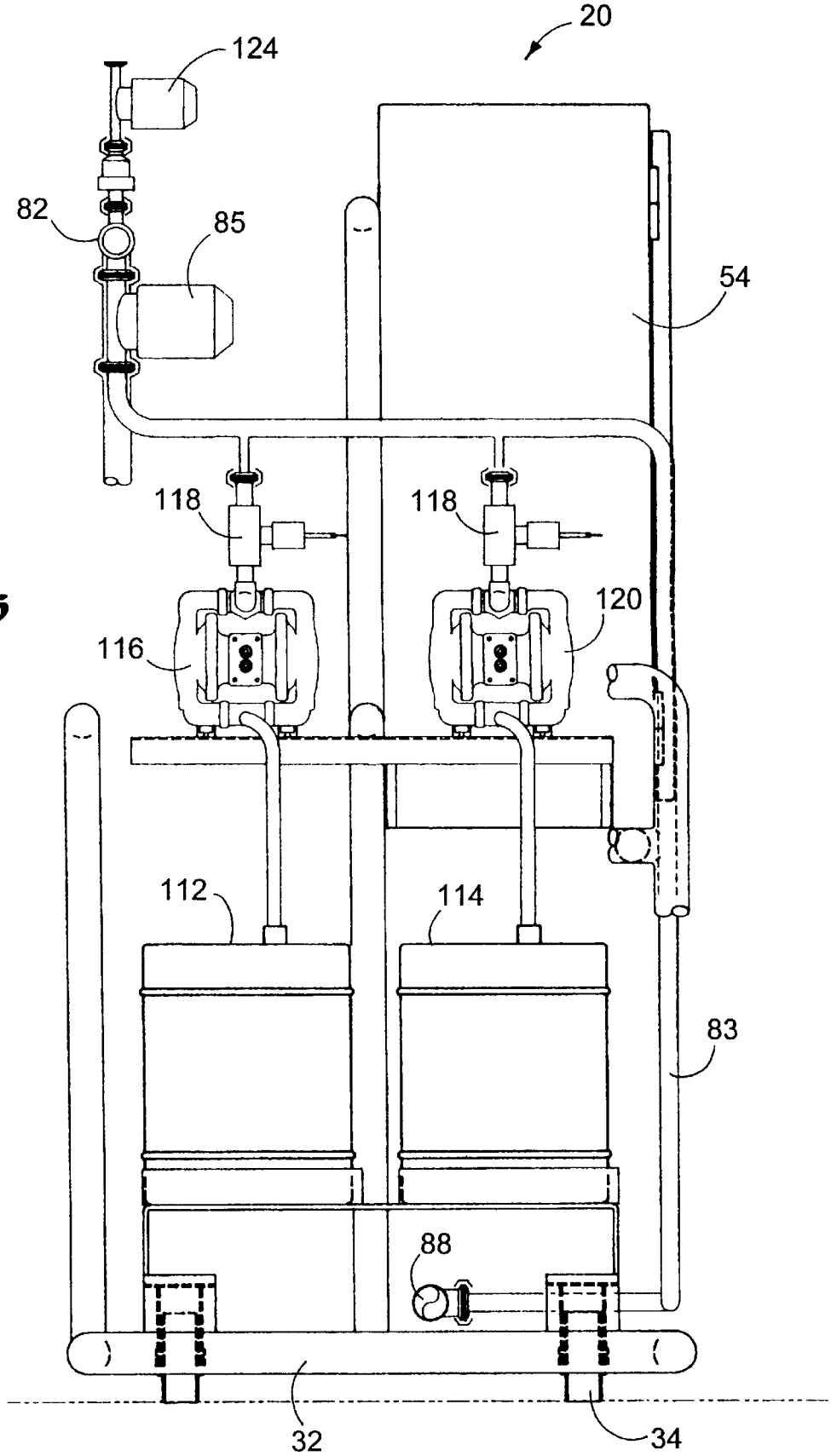
FIG. 5 is an end view of FIG. 3 taken along the line 5—5.

As alluded to earlier, depending on the cleaning process for batch processing facility 22, either water by itself can be circulated through the batch processing system to remove soil or to rinse solution through the batch processing system, or a chemically laden solution can be processed through the batch processing facility 22. In this regard, it can be seen that the preferred embodiment of the present invention includes first chemical supply canister 112, and second chemical supply canister 114 (See FIG. 5). Canisters 112 and 114 are mounted proximate back end 38 above CIP return inlet 88. Typically, first chemical supply canister 112 will include an alkaline solution, whereas second chemical supply canister 114 will include an acidic solution. First chemical pump 116 control the flow of the alkaline solution from canister 112 to chemical loop 83 between piping 84 and return manifold 98 when chemical loop valve 85 is open. Similarly, second chemical pump 120 control the flow of the acidic solution from second canister 114 to chemical loop 83 between piping 84 and return manifold 98 when chemical loop valve 85 is open. At this point, the chemical solution mixes with the fluid passing through the return manifold 98, typically at an elevated temperature. Check valve 118 is provided between chemical loop 83 and canisters 112 and 114 to ensure fluid does not reverse flow into the canisters. Chemical loop 83 provides a means of injecting chemicals into a region of low and constant pressure, thus improving the performance and repeatability of the chemical pumps 120. As shown best in FIG. 5, an air blow valve 124 is provided proximate CIP supply outlet 82 to blow air through piping 84 when cleaning functions are completed to evacuate the piping.

At this point, it is important to understand that apparatus 20 can be used to clean both line circuits and tank circuits.

Figure 9:
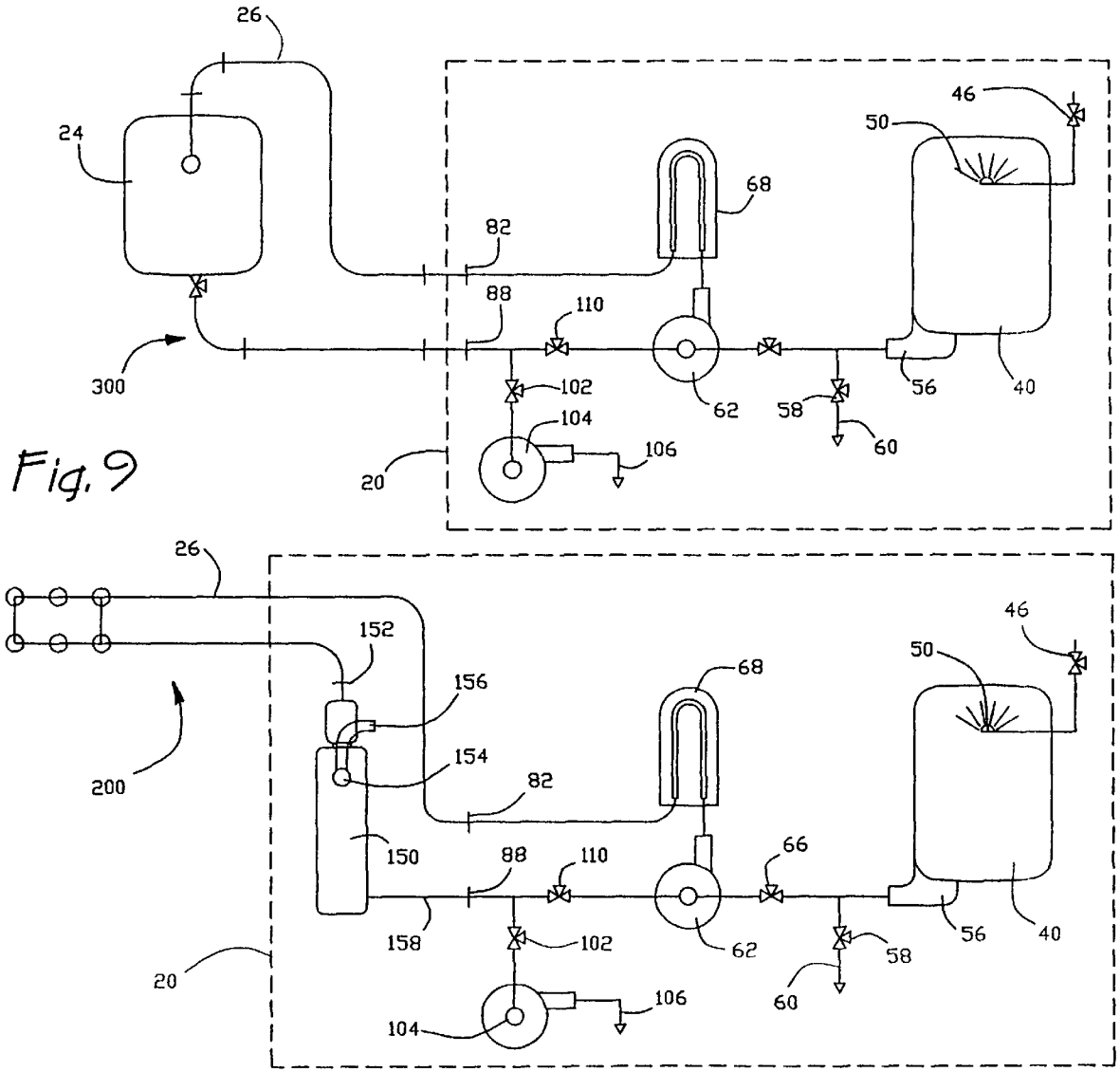
FIG. 9 is a schematic representation of a line circuit and a tank circuit.
Figure 10:
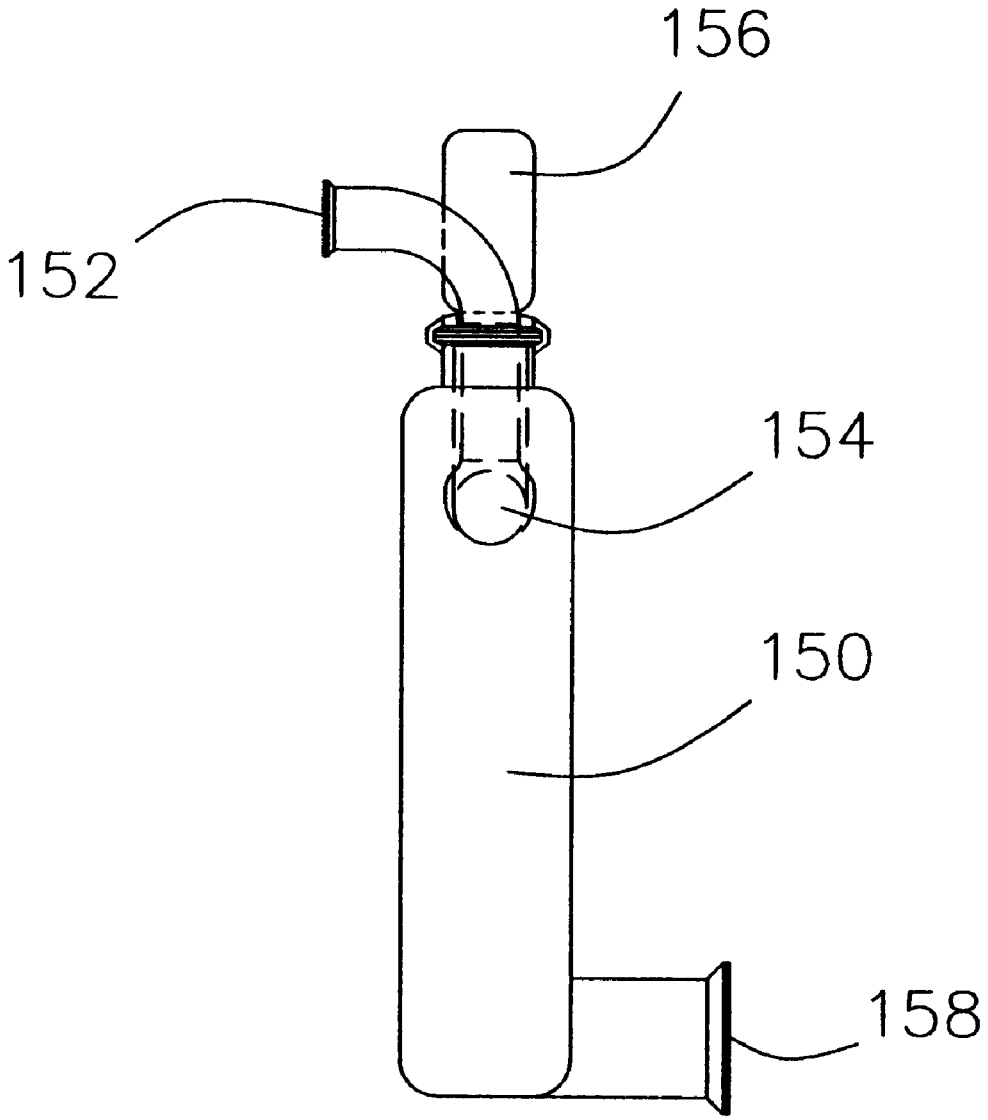
FIG. 10 is a side view of the optional line circuit return tank.

As shown in FIG. 9, the batch processing system can be a line circuit 200 wherein only piping 26 and associated equipment are to be cleaned, or a tank circuit 300 wherein piping 26, tanks 24, and associated equipment are to be cleaned. With a tank circuit, tank 24 can be used as a reservoir for the water or cleaning solution dispensed by CIP apparatus 20 and create the necessary static head for drainage and pumping purposes. If a line circuit is to be cleaned, the present invention, in an alternative embodiment shown in FIG. 10, includes a line circuit return tank 150 to serve as the reservoir. As shown therein, line circuit return tank 150 includes an inlet 152 adapted to be connected to the outlet of the line circuit. Tank 150 further includes spray ball 154 and vent or bleeder 156. After entering through inlet 152 and spray ball 154, the recirculated fluid passes through outlet 158 which is connected to CIP return inlet 88 for recirculation through apparatus 20.

In operation, it can therefore be seen by one of ordinary skill in the art that a number of different cycles can be generated through portable CIP apparatus 20. As referred to earlier, a typical cleaning operation will begin by running a low grade water through water tank 40 to drain pipe 60. In so doing, low grade water will be allowed to enter water tank 40 through first tank inlet 42 and water valve 46. The water will enter water tank through spray nozzle 50 which will spray against the interior walls or water tank 40 and flow downwardly to tank outlet 56. The spray sequence is of importance because, among other things, it ensures any impurities or pyrogenic contaminants which have grown since the preceding use of apparatus 20 are removed from tank 40.

Once water tank 40 is rinsed, tank outlet valve 58 will be closed, and water tank 40 will be filled with water as measured by probe 52. CIP supply pump 62 will then be activated by processor 54 and the water will be pulled through pump suction manifold 64 as tank outlet valve 66 is opened by central processor 54. CIP supply pump 62 will cause the water to flow through heat exchanger 68. However, in the typical pre-rinse cycle, the heat exchanger will not be activated because ambient temperature water in many cases is sufficient to remove loose soil. The water will then exit through CIP supply outlet 82 and be forced through batch processing facility 22 and return to CIP return inlet 88. Alternatively, the solution may first pass through the aforementioned line circuit return tank 150 if a line circuit is being cleaned. The water, now containing soil, will be drawn via gravity into CIP return sensor manifold 90 and into return manifold 98, and to drain. More specifically, return blocking valve 110 will be closed to cause the water to exit through drain pipe 106 and exit 108. Alternatively, optional drain pump 104 can be activated to assist draining. However, some fluid will be temporarily detained in CIP return sensor manifold 90 to a sufficient level and for an adequate time period to activate sensing probes 100 and thereby communicate information to central processor 54. In other words, since tanks being cleaned are generally rinsed by a sequence of bursts, and allowed to drain by gravity between bursts to carry out foam, sediments, etc. from the bottom of the tank, the purpose of weir 92 is to keep probes 100 submerged between bursts and thereby communicate accurate information to processor 54.

The remaining cycles of a typical CIP process will function and pass through portable CIP apparatus 20 following similar patterns. However, variables will be the use of either alkaline solution from canister 112, or acidic solution from canister 114 as well as the activation of heat exchanger 68. For example, after the pre-rinse cycle, water again will be allowed to fill water tank 40, pass through heat exchanger 68, and exit through CIP supply outlet 82. Once recirculation has been estabished, central processor 54 will activate heat exchanger 68 and first chemical pump 116, and open chemical loop valve 85 to allow a measured quantity of alkaline solution as controlled by 116 to enter the flow stream through chemical loop 83 and return manifold 98. It is to be understood that alkaline need not be used first, but rather could be used after or in conjunction with acid. However, in accordance with the preferred embodiment, the alkaline solution will then, along with the water, recirculate through batch processing facility 22 via the CIP apparatus 20 to remove further soil through chemical interaction. Once this alkaline solution has recirculated through the batch processing facility 22 and CIP apparatus 20 for a predetermined length of time as measured by central processor 54, the entire CIP apparatus 20 will again be drained. A second rinse cycle will then be passed through batch processing facility 22 again, typically using water of the second quality.

In a typical CIP processing sequence, the acidic rinse will then be performed wherein water of a reduced a quality will fill water tank 40, pass through heat exchanger 68, and be mixed with acidic solution from canister 114. The acid rinse neutralizes and removes residual alkaline cleaner as well as removes mineral deposits left by water from the reduced quality water rinse.

Finally, once all of these steps have been performed, the typical CIP process will conclude with a post-rinse cycle where water of a higher quality will be passed through batch processing facility 22. This will require first tank inlet 42 to be closed by a water valve 46, and second tank inlet 44 to be opened by water valve 48 to allow water of a higher quality to enter water tank 40. The remaining process and flow pattern through CIP apparatus 20 will then remain the same. Alternatively, water tank 40 may first be rinsed and drained prior to the post rinse cycle to ensure only water of the higher quality is run through the batch processing facility during the post-rinse cycle.

It is to be understood that since apparatus 20 is controlled by processor 54, a number of different programs or recipes can be used to most effectively clean batch processor facility 22. Furthermore, since the processor 54 is continually monitoring the apparatus 20 functions through probes 100 and flow meter 86, the performance of the system can be downloaded into a usable format for the facility and optimization of the process.

The present invention also provides an apparatus with no dead legs, meaning no areas of piping, valving, or equipment which are out of the normal flow path of the cleaning solution. Therefore, no solution will stagnate within the apparatus and contaminate the system, but rather the entire apparatus is completely drainable.

From the foregoing, it can therefore be seen that the present invention provides a portable clean-in-place apparatus for cleaning batch processing systems of, for example, dairies, breweries, pharmaceutical plants, and the like. The CIP apparatus is completely portable and adapted to move about various positions within the facility to clean any and all portions of the batch processing systems. Not only is the present invention portable, but it is minimized in its space requirements to thereby facilitate movement of the portable CIP apparatus through a conventionally sized doorway. This minimization in size is accomplished in part, through the use of appropriately sized tanks and valves, as well as the vertical disposition of its pumps. Moreover, through the placement of the CIP return inlet below the level of the batch processing facility outlet, gravity can be used to drain fluid through the batch processing facility and avoid air pockets and thus loss of prime in any of the pumps of the CIP system. Moreover, through the use of a novel weir device a certain level of fluid can be maintained in the CIP return manifold to ensure sensing probes are submerged within the fluid for an adequate time period to communicate pertinent information to a central processor of the CIP apparatus, but still allow the fluid to drain once a cycle has been completed.

What is claimed is:

1. A portable clean-in-place apparatus, having an inlet and an outlet, the outlet adapted to feed cleaning solution to a batch processing apparatus, the inlet adapted to receive cleaning solution and soil from the batch processing apparatus, the portable clean-in-place apparatus, comprising:

a movable frame;

a water tank mounted on the frame and having at least one inlet and at least one outlet, the inlet adapted to be connected to a water supply;

a supply pump mounted on the frame and having an inlet connected to the water tank and an outlet;

a heat exchanger mounted on the frame and having an inlet and an outlet, the inlet connected to the outlet of the pump;

at least one chemical supply mounted on the frame and having an outlet connected to the outlet of the apparatus;

a processor adapted to control fluid flow between the batch processing apparatus and the portable clean-in-place apparatus; and wherein the frame inlet is mounted below an outlet of the batch processing apparatus to thereby enable the cleaning solution to flow to the portable clean-in-place apparatus using gravity.

2. The portable clean-in-place apparatus of claim 1 wherein the movable frame has a front end and a back end, the apparatus inlet and outlet being provided on the back end of the apparatus.

3. The portable clean-in-place apparatus of claim 1 wherein the water tank has two inlets adapted to be connected to first and second water supplies of differing quality.

4. The portable clean-in-place apparatus of claim 1 wherein the water tank has two outlets, with a first outlet being connected to the pump inlet, and a second outlet being connected to a drain.

5. The portable clean-in-place apparatus of claim 1 wherein the heat exchanger is steam powered.

6. The portable clean-in-place apparatus of claim 1 wherein the heat exchanger is electric powered.

7. The portable clean-in-place apparatus of claim 1 further including first and second chemical supplies, the first chemical supply being alkaline, the second chemical supply being acidic.

8. The portable clean-in-place apparatus of claim 1 further including a processor adapted to selectively programmed to control flow between the water supply, water tank, heat exchanger and chemical supply according to a plurality of recipes.

9. The portable clean-in-place apparatus of claim 1 wherein the movable frame is supported on casters and is no more than three feet wide, seven feet long, and six feet high to facilitate movement of the portable clean-in-place system through a standard size door way.

10. The portable clean-in-place apparatus of claim 9 further including at least one vertically mounted pump to provide flow and occupy limited space on the frame.

11. The portable clean-in-place apparatus of claim 1 wherein the frame inlet includes a large diameter, horizontally disposed mouth separated by a weir, the weir substantially sealing the mouth except for an opening proximate an upper portion, the cleaning solution adapted to flow through the opening until the level of the solution drops below the opening, a level of solution thereby being maintained in the mouth to temporarily submerge sensing probes disposed in a base of the mouth.

12. The portable clean-in-place apparatus of claim 1 further including a line circuit return tank connected to the portable clean-in-place apparatus and having an inlet adapted to be connected to an outlet of a line circuit being cleaned.

13. The portable clean-in-place apparatus of claim 12 wherein the line circuit return tank further includes a vent to bleed off air entrained with fluid returning to the line circuit return tank.

14. A batch processing apparatus having a clean-in-place system for cleaning piping and tanks of the batch processing apparatus, the clean-in-place system being of the type including a water supply, a chemical supply, a heat exchanger and pumps and valves controlling flow of fluid between the water supply, chemical supply, heat exchanger and batch processing apparatus, the clean-in-place system being mounted on a movable frame and including a central processor for controlling the water supply, chemical supply, heat exchanger, pumps, and valves; wherein the clean-in-place system has an outlet for connection to an inlet of the batch processing apparatus, and a return inlet for connection to an outlet of the batch processing apparatus, the clean-in-place return inlet and outlet being provided on a back end of the movable frame; and wherein the clean-in-place return inlet is provided below the batch processing apparatus outlet to facilitate use of gravity for draining purposes and to avoid air pockets in the fluid and loss of prime in the pumps.

15. The batch processing apparatus of claim 14 wherein the water supply, chemical supply, heat exchanger, pumps, valves, and processor are sized and oriented to fit onto the movable frame, the frame being adapted to fit through a standard size door way.

16. The batch processing apparatus of claim 14 wherein the clean-in-place return inlet includes an enlarged diameter, horizontally disposed reservoir defined by a weir, the weir substantially sealing the mouth except for an opening proximate an upper portion, the fluid adapted to flow through the opening when the fluid level reaches the opening, the fluid adapted to remain in the reservoir when the fluid level does not reach the opening, sensing probes disposed in the base of the reservoir thereby remaining temporarily submerged in the fluid.

17. The batch processing apparatus of claim 14 wherein the batch processing apparatus is chosen from a group of batch processing facilities consisting of: dairies, breweries, and pharmaceutical plants.

18. A portable batch processing system clean-in-place apparatus, comprising:

a movable frame having a front end and a back end;

a water tank mounted on the movable frame, the tank having first and second inlets adapted to be connected to first and second water supplies, and first and second outlets;

a supply pump connected to the water tank first outlet;

a heat exchanger having an inlet and an outlet, the heat exchanger inlet being connected to the supply pump, the heat exchanger outlet being connected to a clean-in-place outlet;

first and second chemical supply tanks connected to the clean-in-place outlet;

a chemical supply pump connecting the first and second chemical supply tanks to the clean-in-place outlet;

a clean-in-place return manifold, the clean-in-place return manifold being provided below an outlet of a batch processing system;

a drain pump having open and closed positions, the open position allowing fluid to exit the apparatus through the drain pump, the closed position allowing the fluid to enter the supply pump and recirculate; and a processor electrically connected to the supply pump, chemical supply pump, and drain pump for control of the clean-in-place apparatus.

19. The portable batch processing line clean-in-place apparatus of claim 18 further including a weir disposed in the clean-in-place return manifold, the weir adapted to allow flow of fluid of a first amplitude, and retain flow of fluid of a second, reduced amplitude, sensing probes being disposed in the clean-in-place return manifold upstream of the weir, the sensing probes being electrically connected to the processor.

20. The portable batch processing line clean-in-place apparatus of claim 19 wherein the sensing probes include a temperature sensor and a chemical concentration sensor.

21. The portable batch processing line clean-in-place apparatus of claim 18 wherein the clean-in-place outlet and clean-in-place system manifold are provided on the back end of the frame, and the recirculation water inlets and drain outlet are provided on the front end of the frame.

22. The batch processing line clean-in-place apparatus of claim 18 further include a flow meter between the heat exchanger outlet and clean-in-place outlet, the flow meter being electrically connected to the processor.

23. The batch processing line clean-in-place apparatus of claim 18 wherein the water tank second outlet is connected to a drain outlet, a valve normally closing the drain outlet except when the apparatus is to be completely drained, the drain outlet valve being electrically connected to the processor.

* * * * *